United States Patent [19]

Herr

[11] Patent Number: 4,598,833

[45] Date of Patent: Jul. 8, 1986

[54] TAMPER-EVIDENT CHILD-RESISTANT CLOSURE

[75] Inventor: James E. Herr, East Petersburg, Pa.

[73] Assignee: Kerr Glass Manufacturing Corporation, Los Angeles, Calif.

[21] Appl. No.: 770,681

[22] Filed: Aug. 29, 1985

[51] Int. Cl.[4] ..... B65D 55/02

[52] U.S. Cl. ..... 215/220; 215/258

[58] Field of Search ..... 215/219, 220, 251, 252, 215/258

[56] References Cited

U.S. PATENT DOCUMENTS

| | | | |
|---|---|---|---|
| 3,776,407 | 12/1973 | Cistone | 215/9 |
| 3,863,796 | 2/1975 | Roy | 215/220 |
| 3,926,326 | 12/1975 | Grau | 215/218 |
| 3,968,894 | 7/1976 | Herrmann | 215/220 |
| 4,165,813 | 8/1979 | Babiol | 215/220 |
| 4,330,067 | 5/1982 | Deussen | 215/220 |
| 4,470,513 | 9/1984 | Ostrowsky | 215/253 |
| 4,474,301 | 10/1984 | Davis | 215/220 |
| 4,506,795 | 3/1985 | Herr | 215/252 |
| 4,546,892 | 10/1985 | Couput | 215/252 |

*Primary Examiner*—George T. Hall

*Attorney, Agent, or Firm*—Fitch, Even, Tabin & Flannery

[57] ABSTRACT

A child-resistant, tamper-evident closure having nested inner and outer caps with ratchet teeth on the interfacing skirt walls of the respective caps to cooperate to fasten the closure onto the container, and ratchet teeth on the interfacing top walls of the respective caps for removal of the closure upon simultaneous application of torque and a downward force. The inner cap further includes a tamper-indicating ring depending from the lower edge of its skirt, the ring including a breakable connection for detachably securing the lower portion thereof to the inner cap skirt. A plurality of tabs extending upwardly and radially inwardly from the ring engage an annular shoulder on the container during the removal of the closure to break the ring away from the inner cap skirt.

9 Claims, 6 Drawing Figures

TAMPER-EVIDENT CHILD-RESISTANT CLOSURE

The present invention relates to a child-resistant, tamper-evident closure and, more particularly, to such a closure having nested inner and outer caps.

Two-piece, child-resistant closures for containers which can be readily applied and removed by one having knowledge of their operation have been available for a number of years. Such closures are usually unremovable in the hands of children because of their inability to manipulate the closures in the manner required to remove them from the container. One way of providing such a closure is to have nested inner and outer caps with means such as ratchet teeth formed on the skirts of the caps for turning and applying the inner cap on the container when torque is applied to the outer cap in the closure direction, such ratchet teeth sliding by one another without turning the inner cap when the outer cap is turned in the removal direction. Additional means such as radially extending teeth on the inner side of the outer cap end wall engage with cooperating teeth on the outer side of the inner cap wall when a sufficient downward force on the outer cap is exerted, permitting removal of the inner cap when a torque is simultaneously applied to the outer cap in the removal direction. Safety closures of this general kind are disclosed in Cistone U.S. Pat. No. 3,776,407. However, it has proven desirable to provide such closures with a tamper-evident feature.

Child-resistant closures having a tamper-evident feature have been proposed in the past to enable the user of the product to determine whether the container has been opened. Tamper-evident closures have commonly been made of aluminum or plastic, with one type of closure including an upper cap portion and a lower security ring or band attached to the cap portion by a failure line. When the two-piece cap is removed, the closure breaks along the failure line, leaving the ring separate from the cap portion; see, e.g., U.S. Pat. Nos. 4,330,067, 3,926,326, 4,165,813 and 3,968,894. U.S. Pat. Nos. 3,926,326 and 4,330,067 use a security band which must be heated and shrunk into position on the container neck. It is preferred not to have to use a heated ring at the time of application of the closures; and the more usual child-resistant closures are made with a security band that carries a bead which is stretched and flexed over a large diameter shoulder on the container during the capping operation. After passing over the shoulder, the bead contracts under the container shoulder to a lesser diameter. A weakened area above the bead provided in the band breaks when the closure is unscrewed and the bead engages the underside of the shoulder, where it is held against upward travel to shear the band at the weakened area. Such closures have required highly accurate tolerances in order that the bead diameter pass over the container screw thread and still have a sufficient portion projecting under the container shoulder. These demanding tolerance requirements have led to increased costs for these types of closures.

A major problem with tamper-evident child-resistant closures is to provide a security band which will meet commercial production requirements for capping huge volumes of containers with an extremely low failure rate and which can be used with existing capping equipment.

Accordingly, it is the principle object of the present invention to provide a new and improved, as contrasted to the prior art, closure that is both child-resistant and tamper-evident.

It is an additional object of the present invention to provide a child-resistant closure with a tamper-evident band having folded tabs to grip the container neck and to cause the tamper-evident band to tear off with removal of the closure.

Additional objects and features of the present invention will become apparent from the following detailed description when read in connection with the accompanying drawings.

DETAILED DESCRIPTION OF THE PREFERRED EMBODIMENT

Figure 1:
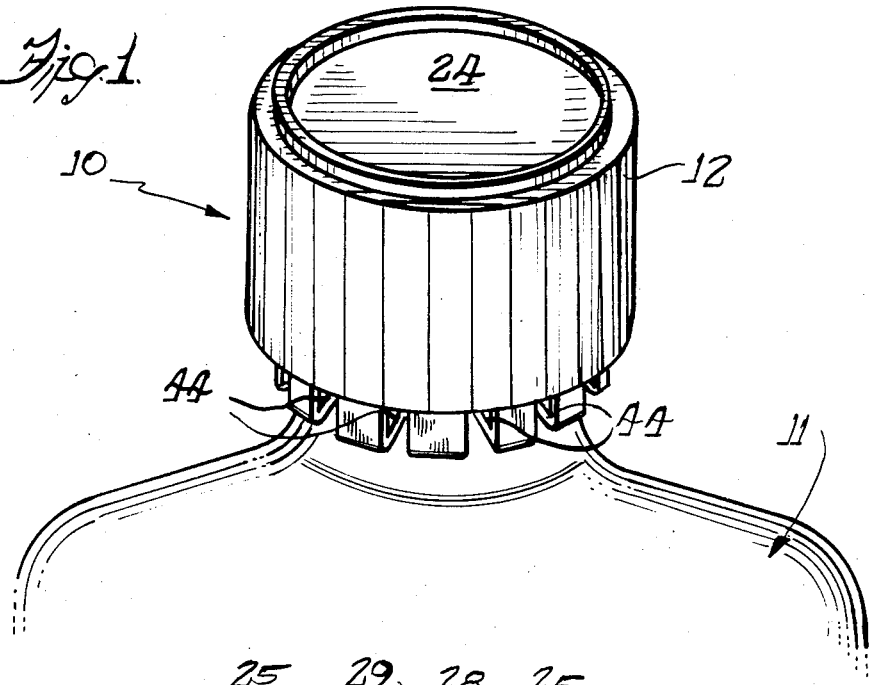
FIG. 1 is an enlarged perspective view of a safety closure having nested inner and outer caps embodying the present invention.

Turning to the drawings there is shown a child-resistant, two-piece closure, generally indicated by 10, fastened to a container (FIGS. 1 and 6) indicated generally by 11. The closure 10 includes an outer cap 12 overlying an inner cap 14, with the inner and outer caps being concentrically aligned. To fasten the closure 10 to the container 11, a generally cylindrically-shaped skirt 15 of the inner cap 14 is formed with a container fastening means such as a spiral screw thread 16 which cooperates with a correspondingly shaped screw thread 18 on the container 11.

Figure 4:
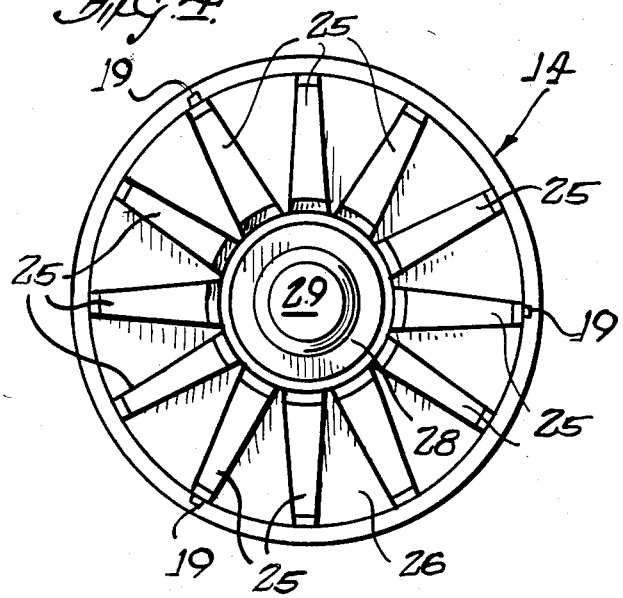
FIG. 4 is a plan view of the top of the inner cap.
Figure 5:
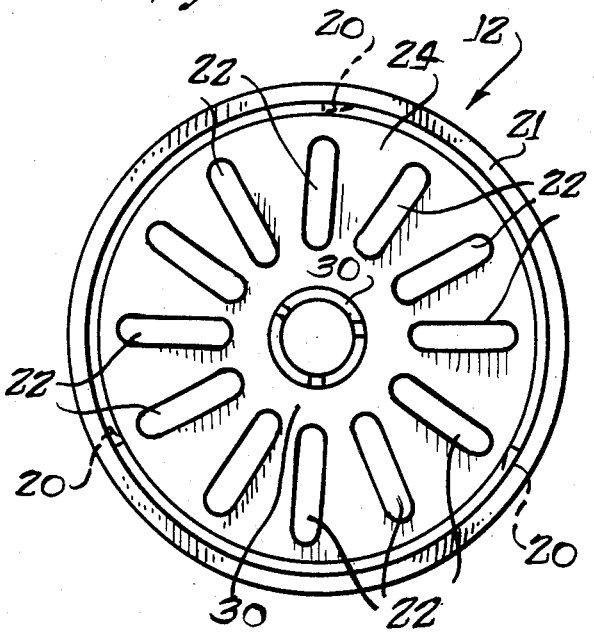
FIG. 5 is a bottom view of the outer cap.

To apply the closure 10 by screwing the thread 16 of the inner cap 14 onto the cooperatively threaded portion 18 of the container 11, one or more ratchet teeth, indicated generally by 19 (FIG. 4), are provided on the skirt 15 of the inner cap 14. The ratchet teeth 19 project radially outwardly for engagement with one or more ratchet teeth 20 (FIG. 5) on the inner side of a generally cylindrically-shaped skirt 21 of the outer cap 12. When the outer cap 12 is turned in the application direction (which is clockwise when viewed from the top of the closure in the drawings), the ratchet teeth 19 interlock with the ratchet teeth 20 so that rotation of the outer cap in a clockwise direction will screw the inner cap 14 onto the container. Conversely, when the outer cap 12 is rotated in the removal direction (which is counterclockwise when viewed from the top of the closure), the ratchet teeth 19, 20 will slide over one another without unscrewing the inner cap 14. This back-ratcheting action will occur provided that the inner cap 14 is tightened sufficiently onto the container so that the torque required to loosen the inner cap from the container must be greater than the torque produced by the backratcheting action. Accordingly, a child who merely rotates the outer cap in the removal direction should not be able to unscrew the closure from the container.

To remove the closure 10 from the container 11, it is necessary to press downwardly on the outer cap 12 and simultaneously apply a torque on the outer cap skirt 21 in the removal direction. With downward pressure of sufficient magnitude applied to the outer cap 12, a plurality of radially extending teeth 22 (best seen in FIG. 5) located on the inner side of the top end wall 24 of the outer cap 12 are moved downwardly to interlocking engagement with similarly extending radial teeth 25 on the top end wall 26 of the inner cap 14 (best seen in FIG. 4). With the respective radially-extending teeth 22, 25 engaged or meshed together, a torque applied to the outer cap skirt 21 in the removal direction causes a similar torque to be translated through the engaged teeth to the inner cap 14 which then unscrews its thread 16 from the container thread 18. The teeth 22 are elongated with lower bottom surfaces disposed in a plane spaced from and parallel to the plane of the inside surface of the top end wall 24. As illustrated, the teeth 22 are generally equally spaced from and angularly spaced about an axis through the center of the top end wall 24, with the parallel side of each of the teeth being generally perpendicular to the plane of the lower surfaces as well as the plane of the inside surface of the top end wall. The teeth 25 on the inner cap 14 project upwardly from the upper surface of the top end wall 26 of the inner cap 14. When viewed from above, the teeth 25 appear triangular in shape.

To normally maintain the respective radially-extending teeth 22, 25 of the outer and inner caps 12 and 14 spaced apart from one another so that the inner cap will not be unscrewed from the container when the outer cap is rotated in the removal direction in the absence of any downwardly exerted pressure on the outer cap, the central portion 28 of the outer surface of the inner cap 14 is provided with an upwardly extending dome 29 which contacts a downwardly-projecting resilient, flexible segmented ring 30 located in the central portion 31 on the inner surface of the end wall 24 of the outer cap 12. Preferably, the ring segments 30 are thin in cross-section and are flared outwardly from their upper to lower ends to facilitate their being deflected outwardly by the dome 29 when the center portion of the top end wall 24 of the outer cap 12 is depressed. In this deflected condition, the ring segments are stressed and will provide a restoring force to lift the teeth 22 when the manually exerted downward force is released.

To hold the inner and outer caps 12, 14 against separation from one another, an inwardly projecting retaining ring 32 is formed on the bottom rim of the skirt 21 of the outer cap 12 so as to project beneath the outer lower surface 33 of the inner cap skirt 15. During assembly, the inner cap is forced inwardly into the outer cap with the retaining ring 32 being flexed outwardly by the skirt 15 until the lower surface 33 of the skirt rim is disposed above the retaining ring 32, which is then free to snap inwardly to the position shown in FIG. 3. The outer cap 12 is preferably formed in a single piece by molding a relatively flexible resilient plastic such as polyethylene or polypropylene while the inner cap 14 is preferably molded from a relatively hard, non-yielding plastic material such as polystyrene or bakelite. To increase the flexibility of the skirt in the area of the ratchet teeth 21, the outer cap skirt 20 may be provided with reduced cross-sectional portions which reduce the friction and torque applied by the outer cap ratchet teeth 20 to the inner cap ratchet teeth 19 during a back-ratcheting operation. See, U.S. Pat. No. 3,863,796, having a common assignee as the present invention, which is herein incorporated by reference.

In keeping with the invention, the inner cap 14 of the closure 10 includes a tamper-indicating assembly 34 including a band or ring 35 detachably connected to the inner cap 14. The assembly 34 is detachably connected to the lower periphery 36 of the skirt 15 of the inner cap 14 by breakable connector means 38. When the outer cap 12 is properly manipulated to unscrew the inner cap from the container 11, the tamper-indicating assembly 34 is restrained from moving upward on the container neck by its annular shoulder 39, causing the assembly 34 to break away from the cap 14. The annular shoulder 39 has a outer diameter larger than the diameter of the threads 18, with the top surface 40 of the shoulder being sloped downwardly and outwardly. The lower surface 41 of the shoulder 39 provides a stop surface for holding the lower ring 35 to cause it to detach, while the neck surface 42 below the shoulder 39 has a diameter smaller than that of the shoulder, with the difference in diameter being varied substantially because of tolerance variations occurring in the container molding operations.

In the past, some tamper-evident closures have been installed in two-step processes involving screwing the closure onto the container and subsequently applying forces or heat to force the tamper-proof band on the closure under an annular shoulder on the container. Others have been installed in one-step processes, but have required relatively close tolerances to be maintained in manufacturing of the closure and of the container neck, or have required a shoulder having a substantially horizontal lower surface or having a substantially larger diameter than the neck surface below it. Manufacturers of plastic or glass containers and bottlers have large investments in existing equipment and do not readily agree to changes in the container finish that might affect their existing equipment and procedures. Thus, there is a need for a reliable tamper-evident, child-resistant closure which can be installed on a container neck having a conventional neck finish with conventional closure applying equipment in a one-step operation, and yet provide under the various tolerance conditions a break-away band or ring 35 on the container. Another problem with many tamper-evident closures is that the bands partially break during the capping operation. For high speed and volume production lines the failure rate must be extremely low to have a commercially acceptable child-resistant, tamper-evident closure.

In accordance with the present invention, the inner cap 14 of the closure 10 includes pivotal, resilient tabs 44 which lock against the lower surface 41 of the annular shoulder 39 to retain the tamper-indicating assembly 34 on the container neck when the closure 10 is removed. The preferred tabs 44 are integral with the ring 35, extending radially inwardly and upwardly from the generally cylindrical ring 35, and are resiliently urged against the neck of the container 11. As the closure 10 is removed, the upward force on the tamper-indicating assembly 34 tends to bow the tabs 44, stiffening them and causing them to engage and grip the container neck more tightly. The closure 10 may be installed on the container 11 by screwing it downwardly onto the container neck, with the tabs 44 assisting in guiding the closure as it is lowered onto the container neck by serving as cam-guiding surfaces to center the cap onto the container finish. The tabs 44 are sufficiently flexible so that, when applying the closure to the container, the tabs 44 readily flex past the large diameters on the closure finish. Accordingly, the tabs 44 are able to perform reliably without requiring exceptionally low tolerances to be maintained in the manufacture of either the closure 10 or the container 11. Each of the tabs 44 of the illustrated closure has a generally trapezoidal shape with a smaller side at the free end of the tab. The tab has a generally uniform thickness over its entire length and projects inwardly and upwardly at an angle of approximately 45°. Tabs can be tapered, decreasing in width and increasing in thickness toward their free ends. The illustrated tabs are preferably about 0.144 inch in the circumferential direction with the tabs being about 0.125 inches in length. About 16 tabs are provided on a 28 mil. cap. The tab thickness in the radial direction may be about 0.036 inch.

After being broken away from the inner cap 14, the tamper-indicating assembly 34 slides down the container neck so that, after the replacement of the closure on the container, there remains a readily discernable visual indication that the container has been opened. In contrast, many other closures employ tamper-proof bands which merely split or open up and then remain attached to the cap after its removal.

Figure 2:
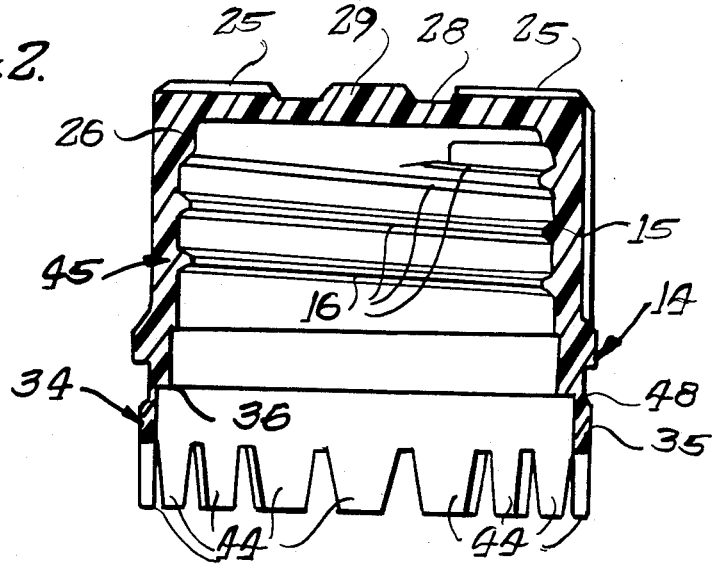
FIG. 2 is an elevational sectional view of the blank for the inner cap of the closure with the tabs for the tamper-evident ring in the pre-formed condition.
Figure 3:
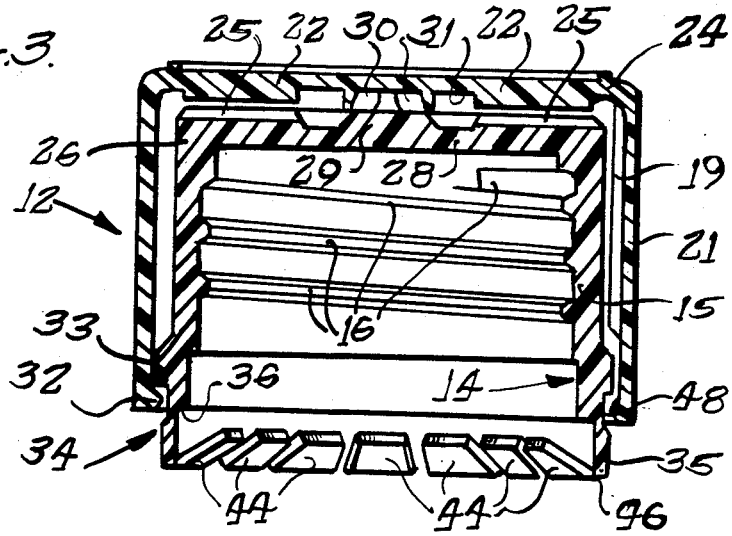
FIG. 3 is an elevational sectional view showing the closure of FIG. 1 with the tabs on the inner cap bent upwardly and radially inwardly.
Figure 6:
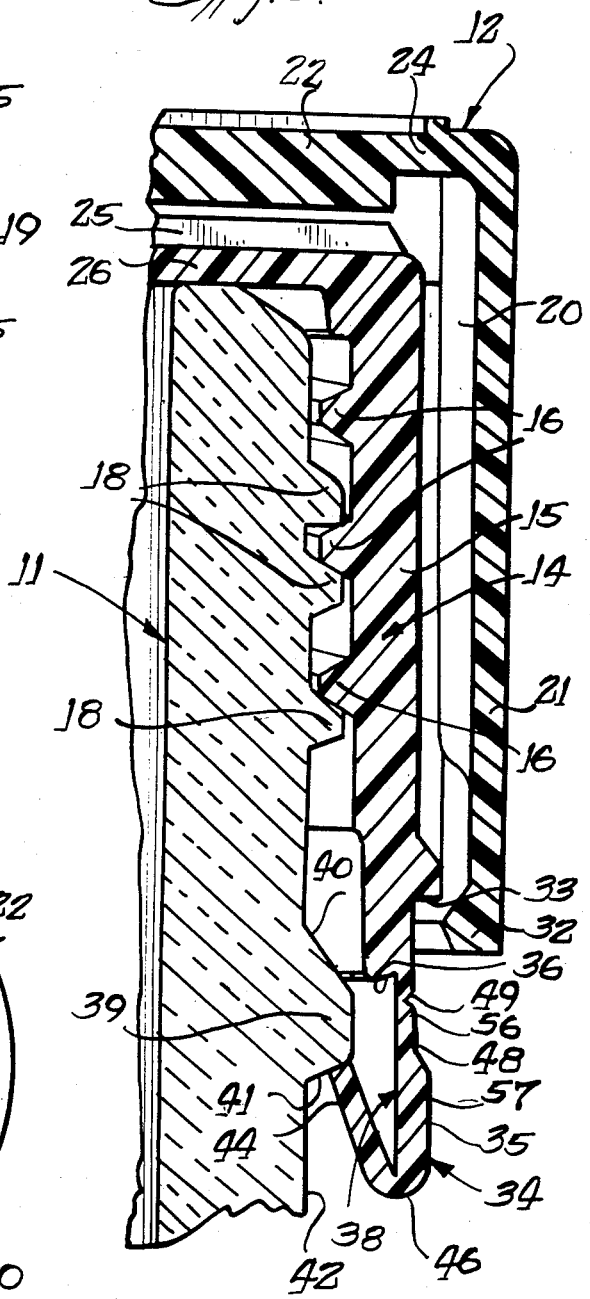
FIG. 6 is a fragmentary, sectional elevational view of a closure in accordance with the present invention shown in installed relation upon a container neck.

Obtaining the desired tab configuration as shown in FIGS. 3 and 6 requires a post-forming operation as conventional molding processes are not capable of producing a closure having the preferred tabs extending upwardly and inwardly as described above. Accordingly, a blank 45 of the inner cap 14 (shown in FIG. 2) is molded with straight vertical tabs 44 extending downwardly. In a separate operation, the tabs are bent radially inwardly and upwardly, with heat being applied to tab joints 46 to set the tabs in a configuration such as that shown in FIGS. 3 and 6.

The tamper-indicating assembly 34 is connected to the inner cap 14 by a weakened area 48 in the form of a reduced cross-sectional web in the ring 35 preferably in a location immediately below the lower end of the skirt 15 of the inner cap 14. The weakened area 48 provides a severing plane normal to the closure and container axis at which the ring 35 will consistently detach from the inner cap 14 when the closure 10 is removed from the container 11. To further ensure that the ring 35 will detach from the inner cap 14 at the desired location, a cut 49 partially through the thin cross-section 48 of the ring 35 may be made in a post-molding operation. The weakened area may be made in various manners such as those disclosed in U.S. Pat. No. 4,506,795, having a common assignee as the present application and which is herein incorporated by reference. The thickness of the narrowed section 48 is preferably about 0.01 inches, while the thickness of the remainder of the ring 35 is preferably about 0.02 inches.

The preferred closure is formed with a reduced cross-sectional web 48 extending downwardly from the outer lower periphery 33 of the skirt wall and in substantial vertical alignment with the center of the skirt wall. A lower portion 57 of the tamper-proof band is thicker in cross section and forms an annular groove 56 with the outer lower surface 33 of the skirt. The retaining ring or bead 32 projects into the groove 56, and when the outer cap is depressed, the retaining ring travels downwardly within the groove 56. It should be noted that the lower periphery 36 of the inner cap 14 is disposed below the outer lower surface 33, the difference in elevation being approximately equal to the height of the radially extending teeth 22, 25 on the outer and inner caps 12, 14. Further, the length of the outer cap sidewall 21 is sized in length so that, when no downward force is exerted on the cap 12, the retaining ring 32 on the sidewall 21 is adjacent the outer lower surface 33 of the inner cap 14. This ensures tht the lower edge of the outer cap sidewall does not contact and damage the tamper-indicating assembly 34 when the nested caps 12, 14, with the teeth 22, 25 meshing, are initially applied to a container 11. Additionally, this ensures that once the tamper-indicating assembly 34 is separated from the inner cap 14, a vertical gap between the closure 10 and the tamper-indicating device 34 is evident and, thus, pronounced, providing a discernible visual indication that the closure 10 has been removed from the container. The thin cross-sectional web 48 is aligned beneath the skirt sidewall so that it will not readily break during the capping operation as the tabs resist outward deflection when sliding along the top surface 40 of the container shoulder 39 and the skirt wall 21 of the outer cap is being flexed inwardly to engage its ratchet teeth 20 with the ratchet teeth 19 of the inner cap skirt wall. The groove also facilitates locating the cutting tools to make the cuts to weaken the web. Thus, the groove 56 and the thin web 48 cooperate with the retaining bead and with the tabs to allow inward deflection of the outer cap wall and downward travel of the retaining bead while resisting breaking of the web during movement of the tabs over the container shoulder.

To briefly review the operation of the closure, as the closure 10 is installed on the container 11, the tabs 44 are forced radially outwardly toward the inside diameter of the ring 35 by the neck finish. The tabs 44 are thus flexed from their normal relaxed position so as to engage and grip the neck. When the closure 10 is later removed, the tabs 44 engage the lower surface 41 of the annular shoulder 39. If sufficient torque is applied to unscrew the cap, the ring 35 will fracture along the narrowed weakened area 48 to permit the closure to be removed from the container, allowing the ring 35 to slide downwardly on the neck finish to provide an indication that the container has been opened.

Thus, it can be seen that an improved closure that is both child-resistant and tamper-evident is provided by the present invention. While a preferred embodiment of the invention has been shown and described herein, there is no intent to limit the invention by this description. On the contrary, the invention is intended to cover all modifications and alternatives falling within the scope of the accompanying claims.

What is claimed is:

1. A child-resistant, tamper-evident closure for sealing an open-topped container having an external screw thread formed on the neck of the container and an outwardly projecting annular shoulder formed below the screw thread, the closure comprising:

an outer cap having a top end wall and a skirt depending from the outer edge thereof;

an inner cap having a top end wall and an internally threaded skirt depending from the outer edge thereof for engagement with the external screw thread on the container, the outer cap overlying the inner cap and being concentric therewith;

first ratchet teeth on the respective caps abutting when the outer cap is turned in the application direction to rotate the two caps together and causing the internal threads on the inner cap to cooperate with the external screw threads on the container to fasten the closure onto the container, the first ratchet teeth of the respective caps sliding over each other when the outer cap is turned in the removal direction;

second ratchet teeth on the respective caps abutting when a downward force and a torque are simultaneously applied on the outer cap in the removal direction for turning the inner cap to release the closure from the container;

tamper-indicating means comprising a ring depending from the lower edge of the skirt of the inner cap, breakable connector means for detachably securing a lower portion of the ring to the inner cap skirt, and a plurality of tabs bent upwardly and radially inwardly from the ring for engaging the annular shoulder of the container during the removal of the closure to break the ring away from the inner cap skirt.

2. A closure in accordance with claim 1 in which the inner cap has a groove and a web formed in the tamper-indicating means and an internally projecting ring on the outer cap projects radially inwardly into the groove and moves vertically in the groove with vertical movement of the outer cap relative to the inner cap, said ring projecting under the skirt of the inner cap to hold the caps against disassembly.

3. A closure in accordance with claim 1 wherein the outer lower edge of the skirt of the inner cap is disposed above the inner lower edge of the skirt, the tamper-indicating means depending from the inner lower edge of the skirt of the inner cap.

4. A child-resistant, tamper-evident closure for sealing an open-topped container having an external screw thread formed on the neck of the container and an outwardly projecting annular shoulder formed below the screw thread, the closure comprising:

an outer cap having a top end wall and a skirt depending from the outer edge thereof;

an inner cap having a top end wall and an internally threaded skirt depending from the outer edge thereof for engagement with the external screw thread on the container, the outer cap overlying the inner cap and being concentric therewith;

ratchet teeth on the inner wall of the outer cap skirt, complementary ratchet teeth on the outer wall of the inner cap skirt, the ratchet teeth on the respective caps abutting when the outer cap is turned in the application direction to rotate the two caps together and causing the internal threads on the inner cap to cooperate with the external screw threads on the container to fasten the closure onto the container, the ratchet teeth of the respective caps sliding over each other when the outer cap is turned in the removal direction;

radially extending teeth and a projecting central portion on the upper surface of the top end wall of the inner cap, complementary radially extending teeth and projecting central portion on the inner surface of the top end wall of the outer cap, the central portions of the respective caps engaging to vertically space the radially extending teeth on the caps so that a downward force on the outer cap is required to engage the radially extending teeth on the caps simultaneously applied with a torque on the outer cap in the removal direction will turn the inner cap to release the closure from the container;

tamper-indicating means comprising a ring depending from the lower edge of the skirt of the inner cap, breakable connector means for detachably securing a lower portion of the ring to the inner cap skirt, and a plurality of tabs bent upwardly and radially inwardly from the ring for engaging the annular shoulder of the container during the removal of the closure to break the ring away from the inner cap skirt.

5. A closure in accordance with claim 4 wherein the outer lower edge of the skirt of the inner cap is disposed above the inner lower edge of the skirt, the tamper-indicating means depending from the inner lower edge of the skirt of the inner cap.

6. The combination of claim 5 wherein the outer lower edge of the inner skirt is disposed above the inner lower edge a distance approximately equal to the height of the radially extending teeth on the inner and outer cap top walls.

7. A child-resistant, tamper-evident closure for sealing an open-topped container having an external screw thread formed on the neck of the container and an outwardly projecting annular shoulder formed below the screw thread, the closure comprising:

an outer cap having a top end wall and a skirt depending from the outer edge thereof;

an inner cap having a top end wall and an internally threaded skirt depending from the outer edge thereof for engagement with the external screw thread on the container, the outer cap overlying the inner cap and being concentric therewith;

a bead on the lower periphery of the outer cap projecting beneath a lower edge of the skirt of the inner cap;

ratchet teeth on the inner wall of the outer cap skirt, complementary ratchet teeth on the outer wall of the inner cap skirt, the ratchet teeth on the respective caps abutting when the outer cap is turned in the application direction to rotate the two caps together and causing the internal threads on the inner cap to cooperate with the external screw threads on the container to fasten the closure onto the container, the ratchet teeth of the respective caps sliding over each other when the outer cap is turned in the removal direction;

radially extending teeth and a projecting central portion on the upper surface of the top end wall of the inner cap, complementary radially extending teeth and projecting central portion on the inner surface of the top end wall of the outer cap, the central portions of the respective caps engaging to vertically space the radially extending teeth on the caps so that a downward force on the outer cap is required to engage the radially extending teeth on the caps simultaneously applied with a torque on the outer cap in the removal direction will turn the inner cap to release the closure from the container;

tamper-indicating means comprising a ring depending from the lower edge of the skirt of the inner cap having a reduced cross-sectional thickness below a lower peripheral edge of the skirt of the inner cap, cuts formed in the web to provide a detachable connection for connecting the lower portion of the ring to the inner cap skirt, said bead of the outer cap projecting into said groove and moving vertically therein with vertical movement of the outer cap relative to the inner cap, said web being located vertically beneath the inner skirt, and a plurality of tabs bent upwardly and radially inwardly from the ring for engaging the annular shoulder of the container during the removal of the closure to break the ring away from the inner cap skirt.

8. A closure in accordance with claim 7 wherein the outer lower edge of the skirt of the inner cap is disposed above the inner lower edge of the skirt, the tamper-indicating means depending from the inner lower edge of the skirt of the inner cap.

9. The combination of claim 8 wherein the outer lower edge of the inner skirt is disposed above the inner lower edge a distance approximately equal to the height of the radially extending teeth on the inner and outer cap top walls.

* * * * *